US007678031B2

(12) United States Patent
Ngu

(10) Patent No.: US 7,678,031 B2
(45) Date of Patent: Mar. 16, 2010

(54) WEIGHT ADJUSTABLE DUMBBELL FOR PERFORMING PUSH UP

(75) Inventor: Steve Ngu, Kwun Tong (HK)

(73) Assignee: Power Sky International Ltd., Kwun Tong, Kowloon (HK)

( * ) Notice: Subject to any disclaimer, the term of this patent is extended or adjusted under 35 U.S.C. 154(b) by 23 days.

(21) Appl. No.: 12/180,900

(22) Filed: Jul. 28, 2008

(65) Prior Publication Data

US 2010/0022365 A1 Jan. 28, 2010

(51) Int. Cl.
*A63B 21/072* (2006.01)
*A63B 21/068* (2006.01)

(52) U.S. Cl. ..... 482/107; 482/108; 482/141

(58) Field of Classification Search ..... 482/49, 482/50, 79, 92–96, 105–109, 141
See application file for complete search history.

(56) References Cited

U.S. PATENT DOCUMENTS 850,964 A * 4/1907 Pelletier et al. ..... 482/108
5,102,124 A * 4/1992 Diodati ..... 482/107
6,123,651 A * 9/2000 Ellenburg ..... 482/104
6,416,446 B1 * 7/2002 Krull ..... 482/108
6,896,645 B1 * 5/2005 Krull ..... 482/107
7,153,244 B2 * 12/2006 Towley et al. ..... 482/108
7,182,716 B1 * 2/2007 Dawson ..... 482/108
7,377,888 B2 * 5/2008 Godbold ..... 482/141
7,468,025 B2 * 12/2008 Hauser et al. ..... 482/141
7,491,155 B2 * 2/2009 Fenelon et al. ..... 482/107
7,549,952 B2 * 6/2009 Towley et al. ..... 482/108
7,588,520 B2 * 9/2009 Nalley ..... 482/107
2003/0148862 A1 * 8/2003 Chen et al. ..... 482/108
2006/0234843 A1 * 10/2006 Chen ..... 482/107
2008/0146420 A1 * 6/2008 Chen ..... 482/108
2009/0023563 A1 * 1/2009 Liang ..... 482/106

* cited by examiner

*Primary Examiner*—Loan H Thanh
*Assistant Examiner*—Victor K Hwang
(74) *Attorney, Agent, or Firm*—Merchant & Gould P.C.

(57) ABSTRACT

A dumbbell has a planar base allowing it to be supported in a stable manner upon the ground, for instance while the user holding a pair of dumbbells performs exercises such as push ups. A compliant sheet on the base provides a high friction slip-resistant face. A pair of flanges disposed on the base and protruding from the base for mounting a handle therebetween and the base has a waisted form. Weights are provided for adjusting the total mass of the dumbbell. Complementary tongue and groove couplers are provided on each weight and on the flanges whereby each weight is releasably fastened to the device.

11 Claims, 3 Drawing Sheets

WEIGHT ADJUSTABLE DUMBBELL FOR PERFORMING PUSH UP

TECHNICAL FIELD

The present invention relates to exercise devices for performing push ups and particularly to dumbbells, or the like, the weight of which is adjustable.

BACKGROUND OF THE INVENTION

Dumbbells have long been used for exercise purposes. In general, dumbbells have been designed for use in arm, shoulder and chest development exercises in which they are raised and lowered by the user. Typical of such dumbbells are the conventional pair of generally cylindrical weights on opposite ends of a hand grip.

Fixed dumbbells have been proposed which have a flat base and which allow push ups to be performed by the user grasping a dumbbell in each hand and resting their bases upon the ground to support his weight. However, despite the flat base, slips can occur when these prior art devices are used to perform push ups in this manner as the rigid weights lack stability when supported on uneven surfaces. These flat-based dumbbells are also well suited to exercises such as bench presses, inclines and shoulder work which typically begin and end with the dumbbells resting on the knees of the user as they are less unwieldy and painful to support in this manner, compared to conventional dumbbells.

Moreover flat-based dumbbells can be used for other exercises for which conventional symmetrical dumbbells are unsuited. These exercises include, for instance, wrist exercises where the device is grasped and held such that the centre of gravity is offset from the handle to apply a torque to the wrist. It will be understood that, due to the symmetrical distribution of weight relative to the handle in conventional dumbbells, this type of exercise cannot be performed. However, the maximum torque that can be applied during wrist exercises as described, is limited in one direction by the prior art device striking the user's wrist or forearm. Furthermore these fixed dumbbells are compact, but are typically sold in sets stored on a rack that is bulky and cumbersome.

Adjustable dumbbells are space and cost efficient exercise equipment, however, adjustable dumbbells also suffer from some drawbacks. Conventionally adjustable dumbbells have incorporated plates and locking collars secured to the ends of an extended handle but it can be time-consuming removing and replacing the locking collars and plates to change or adjust both dumbbells. It is an object of the present invention to overcome or substantially ameliorate the above disadvantages or more generally to provide an improved exercise device.

DISCLOSURE OF THE INVENTION

According to one aspect of the present invention there is provided a dumbbell including:

a rigid base having first and second opposing sides, the first side having means for supporting the dumbbell upon a support surface;

a pair of flanges fixed to the base and protruding in a first direction outwardly from the second side, each flange having an inner and an opposing outer side;

a handle having opposing ends mounted to respective ones of the flanges so as to span between the inner sides;

an aperture provided between the handle and the base for receiving the user's fingers;

two weights, a complementary elongate tongue and a groove pair by which each weight is releasably fastened to the base, wherein one of the tongue and groove pair is disposed on each weight and the other of the tongue and groove pair is fixed to the base, and a latch for preventing relative sliding movement between the tongue and groove of each pair.

Preferably said other of the tongue and groove pair is disposed on and the outer side of each flange.

Preferably one of the tongue and groove pair is integral with the weight and the other of the tongue and groove pair is integral with the flange.

Preferably both of the ones of the tongue and groove pair disposed on the outer sides of the flanges are elongated parallel to one another.

Preferably the first side is substantially planar, the handle is elongated substantially parallel to the first side, the first direction is generally perpendicular to the first side and both of the ones of the tongue and groove pair disposed on the outer sides of the flanges are elongated in the first direction.

Preferably the latch comprises a push-to-extend, push-to-retract latch mounted to each flange, each weight having a recess for cooperating with the latch.

Preferably the pair of flanges are integral with a web extending between the flanges to form a U-shape member fixed to the base.

Preferably a compliant sheet is fixed to the first side to provide a planar slip-resistant face for supporting the device.

Preferably the mass of the device is substantially evenly distributed either side of a first plane orthogonal to the planar surface through a longitudinal axis of the handle. Preferably the mass of the base, handles and flanges is substantially evenly distributed either side of a second plane orthogonal to the planar surface and to the first plane.

Preferably each weight is tapered, having a relatively broad inner end complementary to the second side of the base and an opposing outer end which is relatively narrow.

Preferably the first and second sides of the base are substantially parallel and the base has longitudinally opposing end portions on which the flanges are disposed and which are separated by a waist portion.

In another aspect the invention provides an exercise device including:

a rigid base having first and second opposing sides and longitudinally opposing end portions, the first side having a planar surface, the longitudinally opposing end portions separated by a waist portion;

a compliant sheet fixed to the first side to provide a planar slip-resistant face for supporting the device;

a pair of flanges, each disposed proximate one of the longitudinally opposing ends and arranged to protrude away from the second side and joined by a web portion disposed adjacent the second side;

a handle, opposing ends of the handle mounted to respective ones of the flanges;

an aperture provided between the handle and the base for receiving the user's fingers;

a pair of weights;

a tongue and groove coupler pair releasably connecting each weight to a respective flange and a latch cooperating with each tongue and groove coupler pair for preventing relative sliding movement between the respective weight and flange.

This invention provides an exercise device which is effective and efficient in operational use, and which has an overall simple design which minimizes manufacturing costs and maximizes performance.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
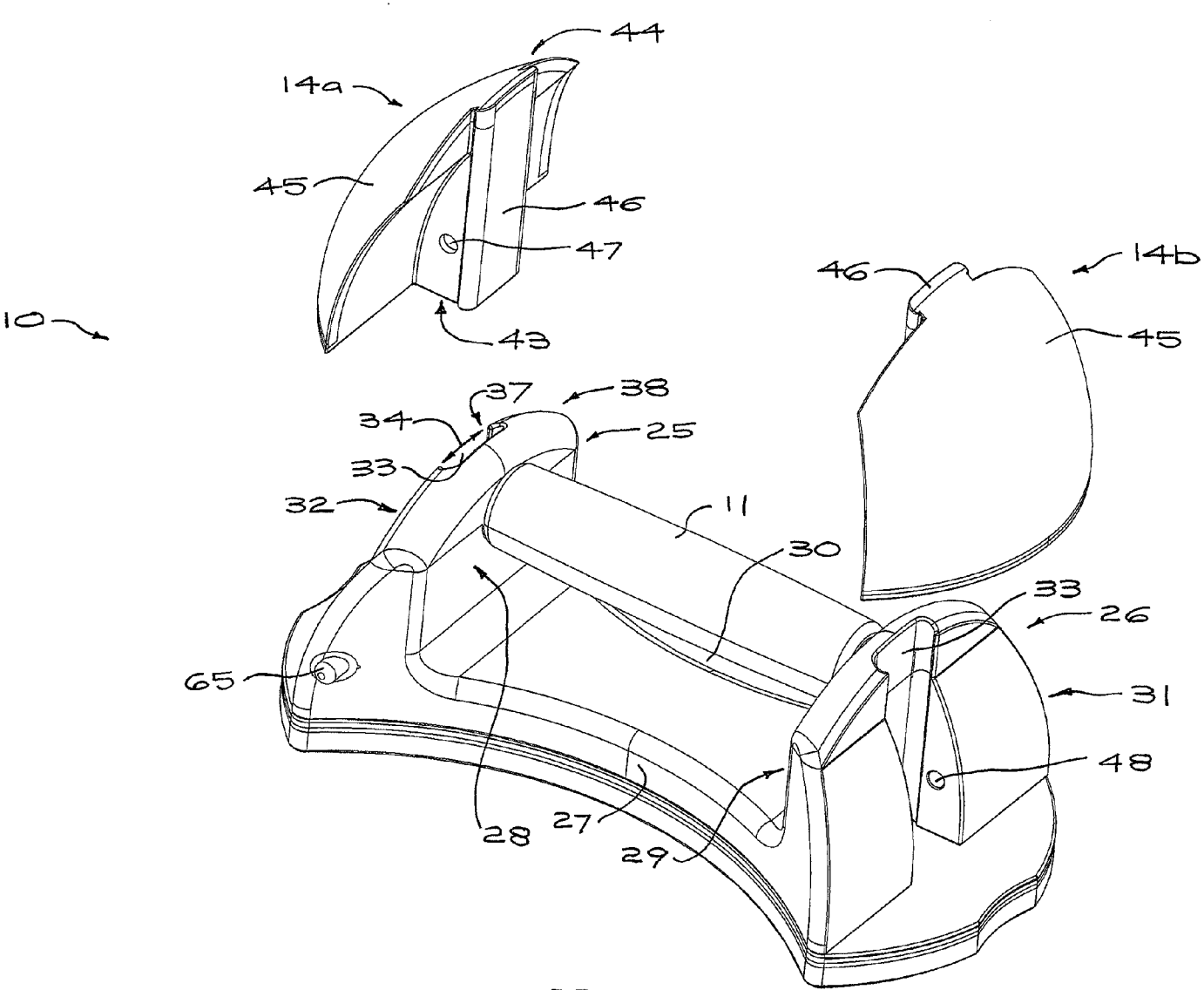
FIG. 1 is a pictorial view of an embodiment of the dumbbell of the present invention showing the weights removed.
Figure 2:
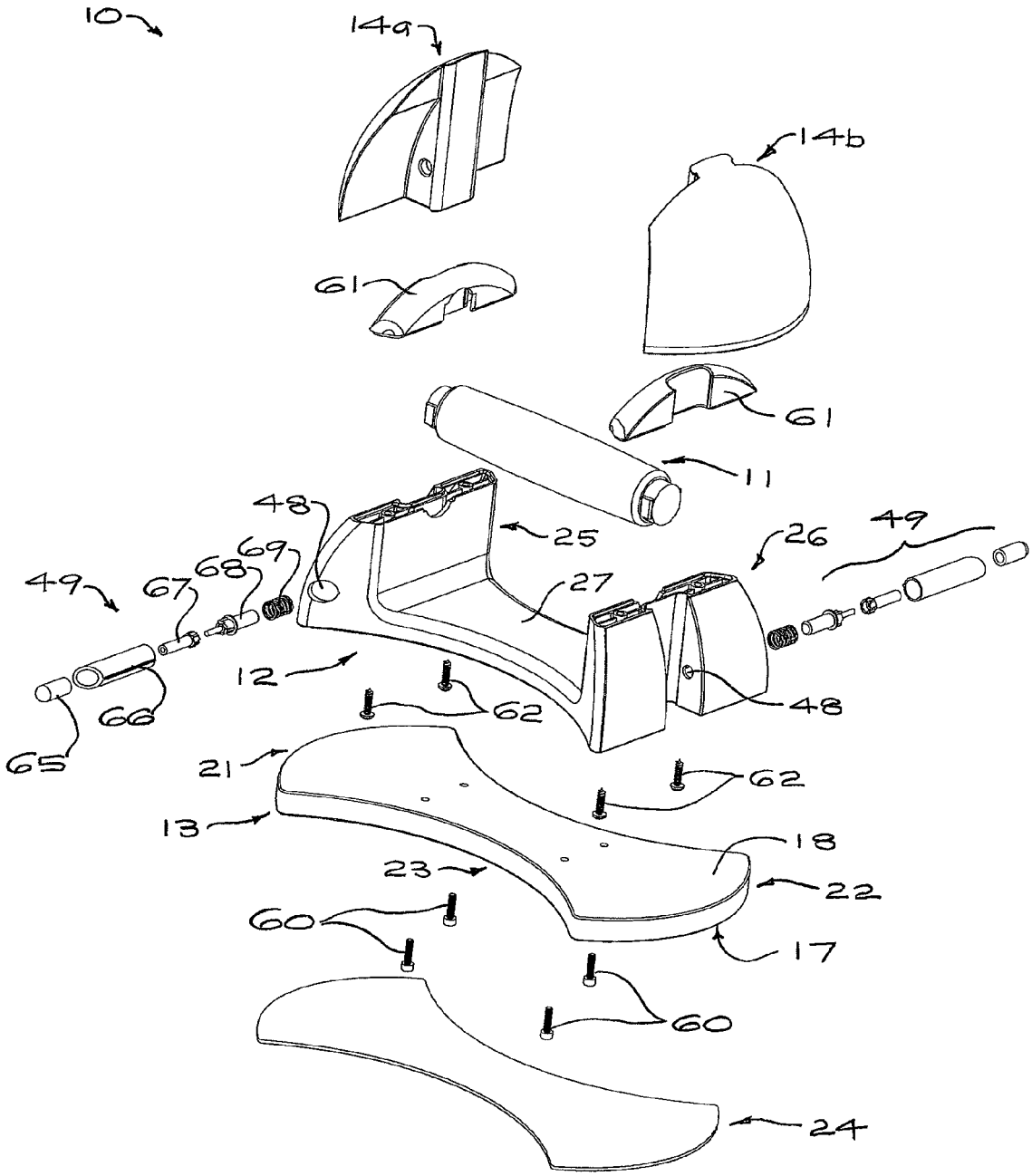
FIG. 2 is a completely exploded view of the dumbbell of FIG. 1.
Figure 5:
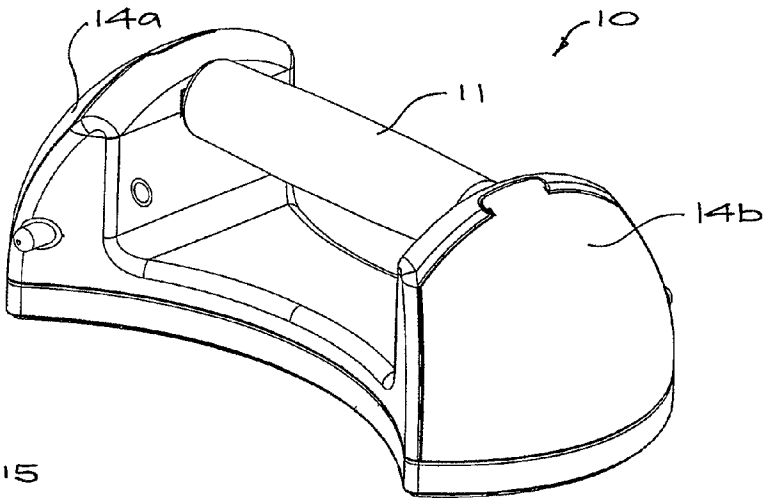
FIG. 5 is a pictorial view of the dumbbell of FIG. 1 assembled in a use configuration.
Figure 3:
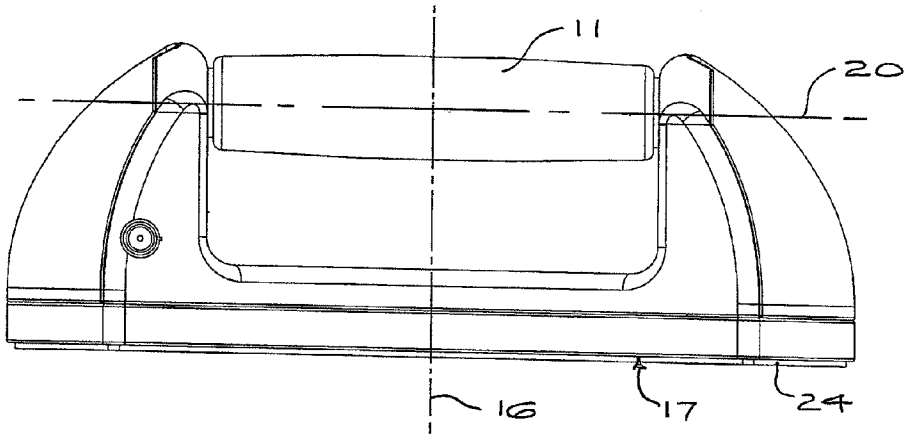
FIG. 3 is a side elevation of the dumbbell of FIG. 1.
Figure 4:
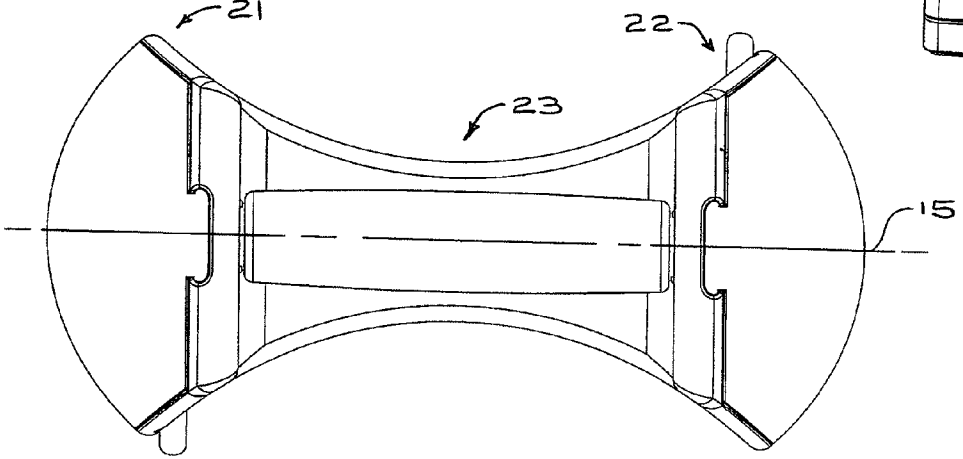
FIG. 4 is a plan view from above of the dumbbell of FIG. 1.

Referring to the drawings, an exercise device or dumbbell 10 according to an embodiment of the present invention includes a handle 11 mounted to a generally U-shaped member 12 fixed upon a base 13. The weight of the dumbbell 10 is adjustable by means of like weights 14*a*, 14*b* removably mounted generally proximate opposing ends of the handle 11.

The dumbbell 10 is generally symmetrical about first and second mutually orthogonal planes 15, 16 both of which are orthogonal to the lower planar side 17 of the base 13. Arranged with (or without) both the weights 14*a*, 14*b* in place the mass of the dumbbell 10 is substantially evenly distributed either side of the longitudinal plane 15 in which the longitudinal axis 20 of the handle 11 lies. The mass of the base 13, handle 11 and member 12 is substantially evenly distributed either side of the transverse plane 16. This flat-based dumbbell may be used to perform push ups with the user grasping the handle 11 of a dumbbell in each hand and resting their bases upon the ground to support his weight.

The base 13 is rigid, preferably being formed from cast iron, and is flat with parallel first and second opposing sides 17, 18. The base 13 has a waisted form with longitudinally opposing end portions 21, 22 separated by a narrower waist portion 23.

This shape allows, for instance, wrist exercises such as those described above to be performed by applying a relatively greater torque (as the user's wrist or forearm is received in the waisted portion 23) and this is achieved without compromising stability when used to perform push ups in the manner also described above. Fixed, as by adhesive, to the lower side 17 of the base 13 is a compliant sheet 24 of a resilient polymeric material such as EVA. This sheet 24 is thereby able to conform to irregularities in surfaces upon which it is supported and provides a high friction slip-resistant face.

The member 12 is a moulded plastic component fixed by fasteners 60 to the second side 18 of the base 13. The member 12 is generally U-shaped, including a pair of opposing flanges 25, 26 either side of the plane 16 and extending outwardly from the second side 18 of the base to support the handle 11. The flanges 25, 26 are alike in shape and are integral with a web 27 extending therebetween. The flanges 25, 26 include cap portions 61 at their outermost ends secured by fasteners 62 to fix opposing ends of the handle 11 therebetween. The handle 11 spans between the facing inner surfaces 28, 29 of the flanges 25, 26 with an aperture 30 provided between the handle 11 and the web 27 for receiving the user's fingers. On outer sides 31, 32 opposing the inner sides 28, 29, each flange 25, 26 includes a groove 33 with a reentrant symmetrical cross section shape having a narrow throat 34. Each groove 33 is elongated to extend generally perpendicular to the base 13 for the length of each flange 25, 26 and extend to an open mouth 37 in the cap portion 61 adjacent the outermost ends 38 of the flanges 25, 26.

The weights 14*a*, 14*b* are alike and interchangeable. They may be formed of cast iron and have a tapered shape, tapering inwardly from the inner end 43 to the outer end 44 so that centre of gravity of each weight is offset toward its inner end 43. The inner end 43 is flat and complementary to the second side 18 of the base against which it may abut. Extending between the ends 43, 44 the weights 14*a*, 14*b* have a convex outermost face 45 and an integral tongue 46 complementary to the groove 33. A recess 47 is formed in the tongue 46.

Mounted within an opening 48 in each of the flanges 25, 26 is a latch 49. The latch 49 includes an actuating knob 65 slidingly received within a cam barrel 66 which is itself received in the opening 48. The cam barrel 66 cooperates with a turning core 67 and acts on a pin 68, moved longitudinally by the knob 65 against the urging of a compression spring 69. In the retracted position shown in FIG. 1, the pin 68 is retracted within the opening 48, allowing the tongues 46 of weights 14*a*, 14*b* to be entered into or removed from the groove 33. The pin 68 is changed from the retracted position to the extended position by pressing inwardly on the knob 65 until a stop is felt, and then releasing the pressure to allow the pin 68 to be held in position in which it extends outwardly from the opening 48. With the weights in place, the tongues received in the grooves and the inner end 43 supported on the second side 18 of the base, then operating the latch 49 in this manner the pin 68 is received in the recess 47 preventing relative sliding movement between the tongue and groove of each pair. The procedure is identical to change from the extended to the retracted position, hence, a push-to-retract/push-to-extend latch operation is created which resembles that of a typical retractable ballpoint pen.

Aspects of the present invention have been described by way of example only and it should be appreciated that modifications and additions may be made thereto without departing from the scope thereof.

The invention claimed is:

1. A dumbbell including:

a rigid base having first and second opposing sides, the first side being substantially planar and having means for supporting the dumbbell upon a support surface;

a pair of flanges fixed to the base and protruding in a first direction outwardly from the second side, each flange having an inner and an opposing outer side;

a handle having opposing ends mounted to respective ones of the flanges so as to span between the inner sides;

an aperture provided between the handle and the base for receiving the user's fingers;

two weights;

a complementary elongate tongue and a groove pair by which each weight is releasably fastened to the base, wherein one of the tongue and groove pair is disposed on each weight and the other of the tongue and groove pair is fixed to the base, disposed on the outer side of each flange; and a latch for preventing relative sliding movement between the tongue and groove of each pair.

2. The dumbbell of claim 1 wherein the handle is elongated substantially parallel to the first side, the first direction is generally perpendicular to the first side and both of the other of the tongue and groove pair disposed on the outer sides of the flanges are elongated in the first direction.

3. The dumbbell of claim 1 wherein the latch comprises a push-to-extend, push-to-retract latch mounted to each flange, each weight having a recess for cooperating with the latch.

4. The dumbbell of claim 1 wherein the pair of flanges are integral with a web extending between the flanges to form a U-shape member fixed to the base.

5. The dumbbell of claim 1 wherein each weight is tapered, having a relatively broad inner end complementary to the second side of the base and an opposing outer end which is relatively narrow.

6. The dumbbell of claim 1 wherein the first and second sides of the base are substantially parallel.

7. The dumbbell of claim 1 wherein the flanges are disposed proximate longitudinally opposing end portions of the base and the end portions of the base are separated by a waist portion.

8. An exercise device including:

a rigid base having first and second opposing sides and longitudinally opposing end portions, the first side having a planar surface, the longitudinally opposing end portions separated by a waist portion;

a compliant sheet fixed to the first side to provide a planar slip-resistant face for supporting the device;

a pair of flanges, each disposed proximate one of the longitudinally opposing ends and arranged to protrude in a first direction away from the second side and joined by a web portion disposed adjacent the second side;

a handle, opposing ends of the handle mounted to respective ones of the flanges;

an aperture provided between the handle and the base for receiving the user's fingers;

a pair of weights;

a tongue and groove coupler pair releasably connecting each weight to an outer side of a respective flange; and a latch cooperating with each tongue and groove coupler pair for preventing relative sliding movement between the respective weight and flange.

9. The dumbbell of claim 8 wherein the handle is elongated substantially parallel to the first side, the first direction is generally perpendicular to the first side and both of the tongue and groove pair disposed on the outer sides of the flanges are elongated in the first direction.

10. The dumbbell of claim 8 wherein the latch comprises a push-to-extend, push-to-retract latch mounted to each flange, each weight having a recess for cooperating with the latch.

11. The dumbbell of claim 8 wherein the pair of flanges are integral with a web extending between the flanges to form a U-shape member.

* * * * *